US008424714B2

(12) United States Patent
Kruse et al.

(10) Patent No.: US 8,424,714 B2
(45) Date of Patent: Apr. 23, 2013

(54) ALIGNMENT FEATURES FOR A CART

(75) Inventors: Shawn Kruse, Los Alamitos, CA (US); Daniel Barbalho, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 626 days.

(21) Appl. No.: 12/483,555

(22) Filed: Jun. 12, 2009

(65) Prior Publication Data

US 2010/0314904 A1 Dec. 16, 2010

(51) Int. Cl.
*B65D 25/10* (2006.01)

(52) U.S. Cl.
USPC ..... 220/756; 220/908; 220/694

(58) Field of Classification Search ..... 220/908, 220/756, 694, 729, 752, 699, 670, 671, 908.1
See application file for complete search history.

(56) References Cited

U.S. PATENT DOCUMENTS

| | | | | |
|---|---|---|---|---|
| 4,765,503 | A * | 8/1988 | Otto et al. | 220/659 |
| 5,088,750 | A * | 2/1992 | Beese et al. | 280/47.26 |
| 7,100,791 | B2 * | 9/2006 | Berger | 220/831 |
| 7,290,775 | B2 * | 11/2007 | Parker et al. | 280/47.26 |
| 8,096,565 | B2 * | 1/2012 | Meers | 280/47.26 |
| 2003/0213808 | A1 * | 11/2003 | Berger | 220/832 |
| 2004/0074913 | A1 * | 4/2004 | McDade et al. | 220/908.1 |
| 2004/0206759 | A1 * | 10/2004 | Busch | 220/315 |

* cited by examiner

*Primary Examiner* — Mickey Yu
*Assistant Examiner* — Kareen Rush
(74) *Attorney, Agent, or Firm* — Carlson, Gaskey & Olds PC

(57) ABSTRACT

An example cart includes a body establishing an opening for loading and unloading items from the body and a skirt extending downwardly from a portion of the body. A plurality of support ribs span between the body and the skirt. The support ribs establish a lifter receiving area together with an outwardly facing surface of the body and an inwardly facing surface of the skirt. A feature is disposed on an outwardly facing surface of the skirt. The feature indicates the location of the lifter receiving area.

21 Claims, 5 Drawing Sheets

ALIGNMENT FEATURES FOR A CART

BACKGROUND

This invention relates to indicators for carts, and more particularly, to lifter alignment indicators for the carts.

Carts for moving trash, recyclables, and other items are well known. Some municipalities provide residents with carts, especially roll-out carts. The residents load these carts with trash, for example, and, once filled, move the filled carts to a collection location. A trash truck then maneuvers to a position adjacent the collection location. A lifter extending from the trash truck engages a lifter receiving area on the cart before lifting and rotating the cart to a position where the trash pours from the cart into the trash truck. Moving trash from the cart to the truck in this manner is often referred to as "tipping" the cart. Once emptied, the lifter returns the cart to the collection location.

Carts include portions that establish the lifter receiving area. Receiving the lifter within the lifter receiving area facilitates moving or tipping the cart.

SUMMARY

An example cart includes a body establishing an opening for loading and unloading items from the body and a skirt extending downwardly from a portion of the body. A plurality of support ribs span between the body and the skirt. The support ribs establish a lifter receiving area together with an outwardly facing surface of the body and an inwardly facing surface of the skirt. A feature is disposed on an outwardly facing surface of the skirt. The feature indicates the location of the lifter receiving area.

Another example cart includes a body extending axially and establishing an opening for loading and unloading items from the body. A skirt is secured to the body. A plurality of support ribs extend between the skirt and the body. The plurality of ribs, the skirt, and the body establish a lifter receiving area. The skirt includes at least one feature indicating the location of the lifter receiving area.

These and other features of the example disclosure can be best understood from the following specification and drawings, the following of which is a brief description.

DETAILED DESCRIPTION

Figure 1:
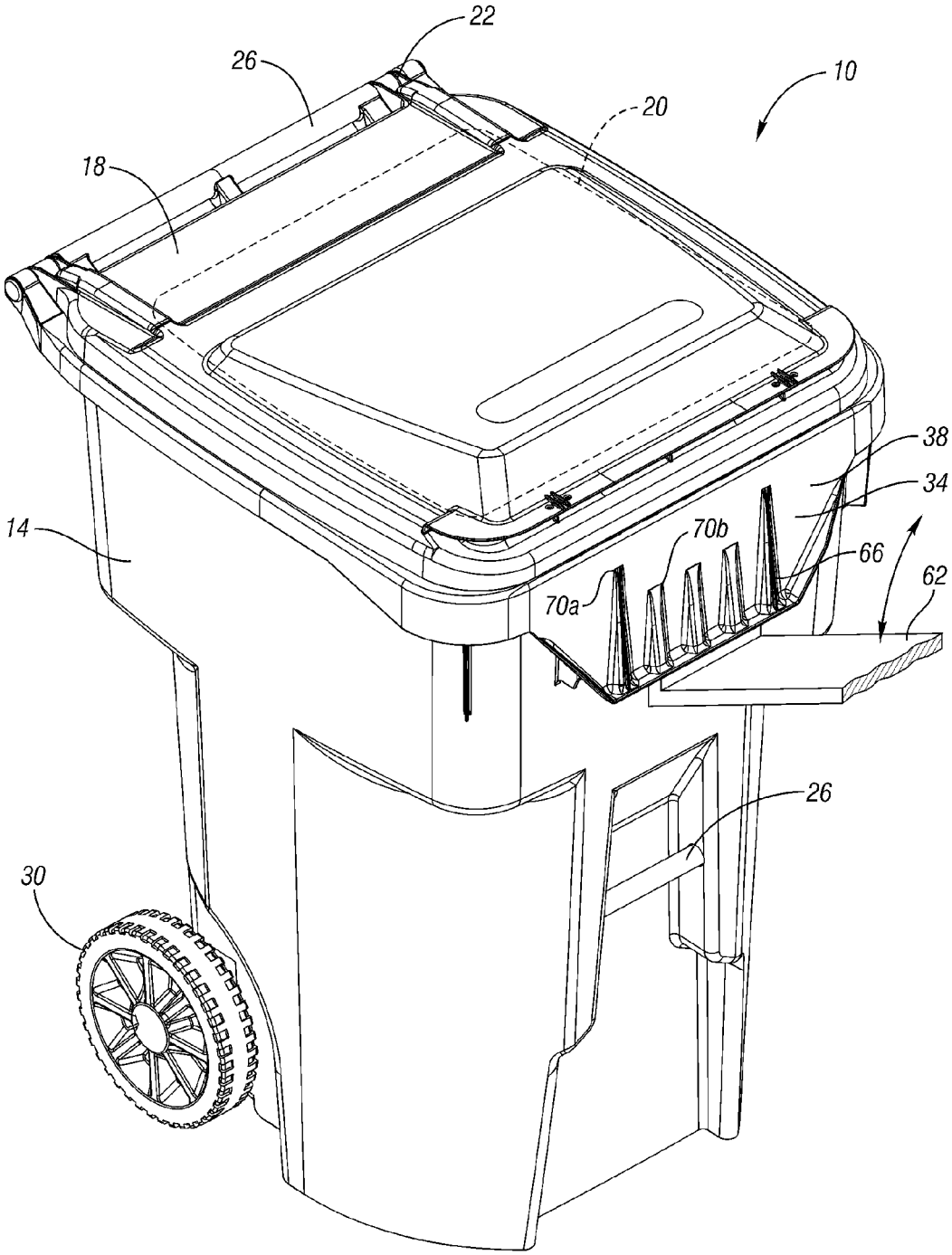
FIG. 1 is a perspective view of an example roll-out cart having an example skirt.
Figure 2:
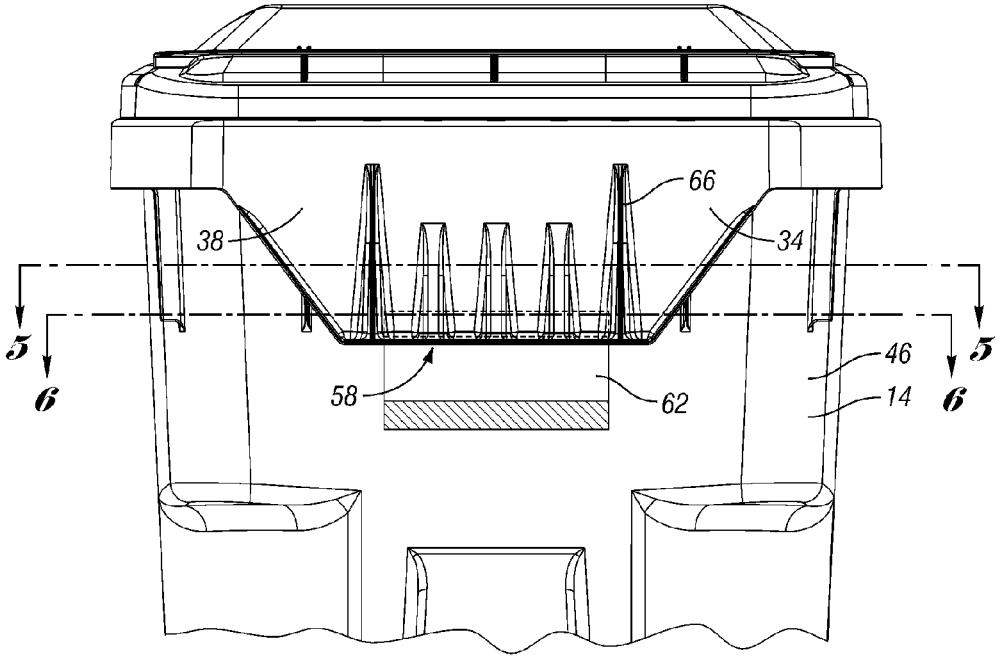
FIG. 2 is a partial side view of the FIG. 1 cart.
Figure 3:
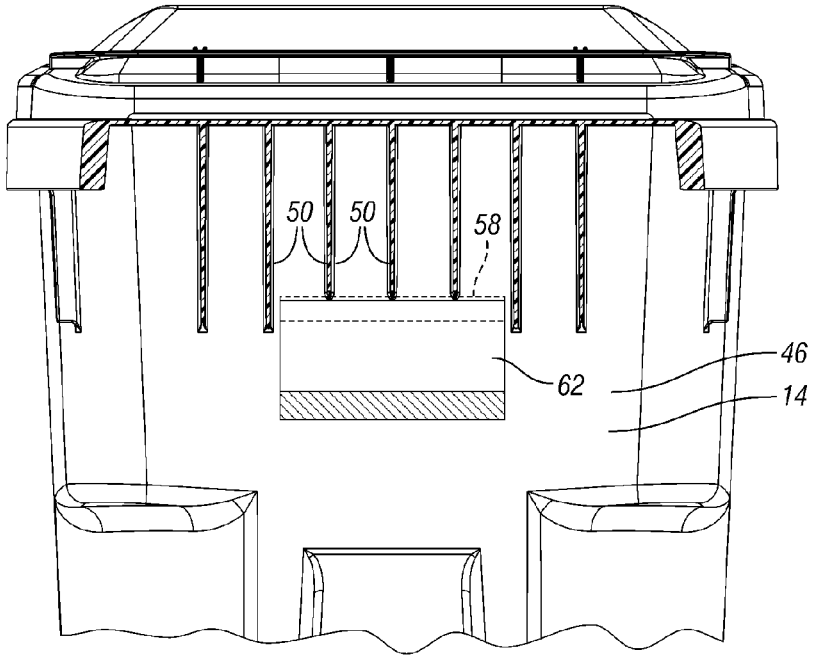
FIG. 3 is a side view of the FIG. 1 cart with the skirt removed.
Figure 4:
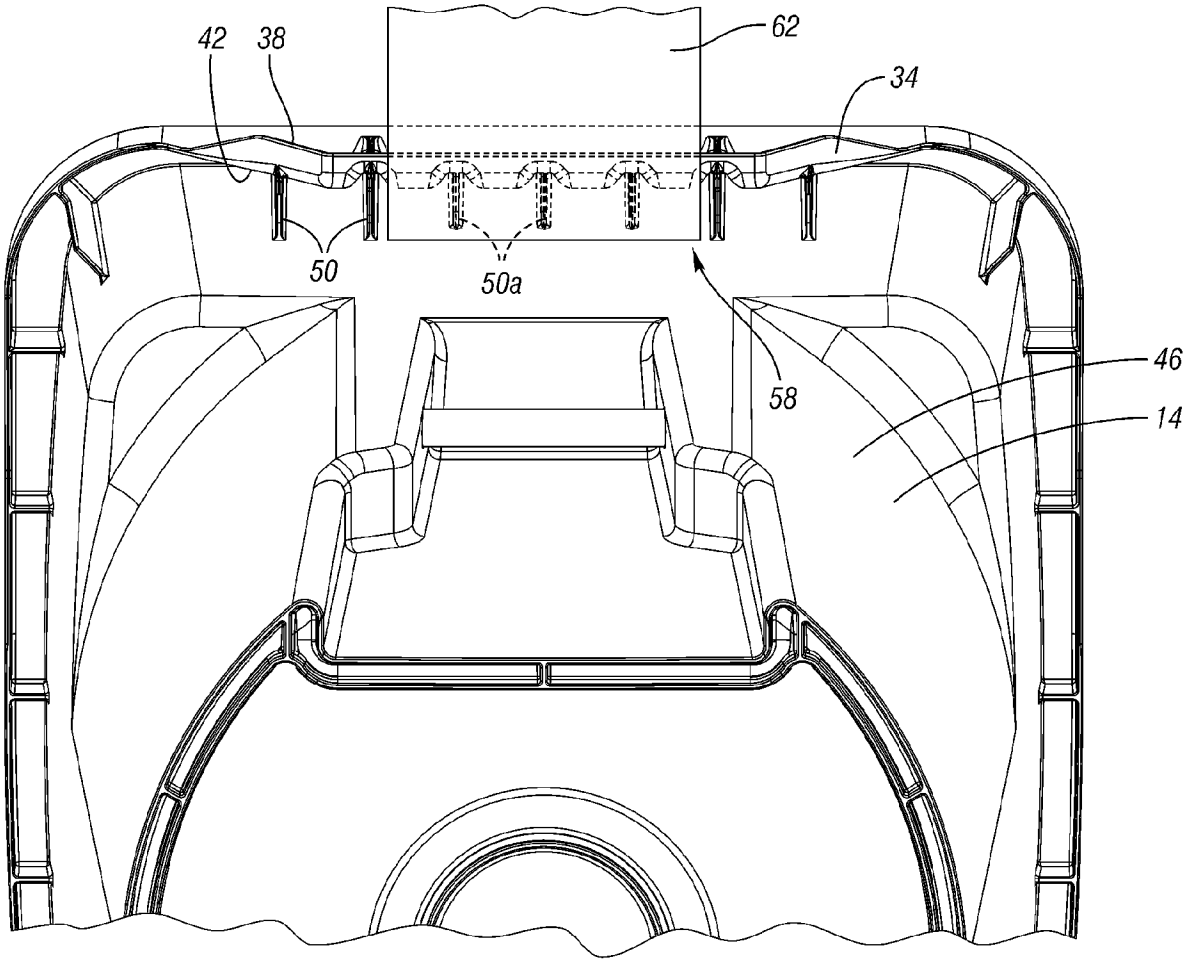
FIG. 4 is a partial end view of the FIG. 1 cart.
Figure 5:
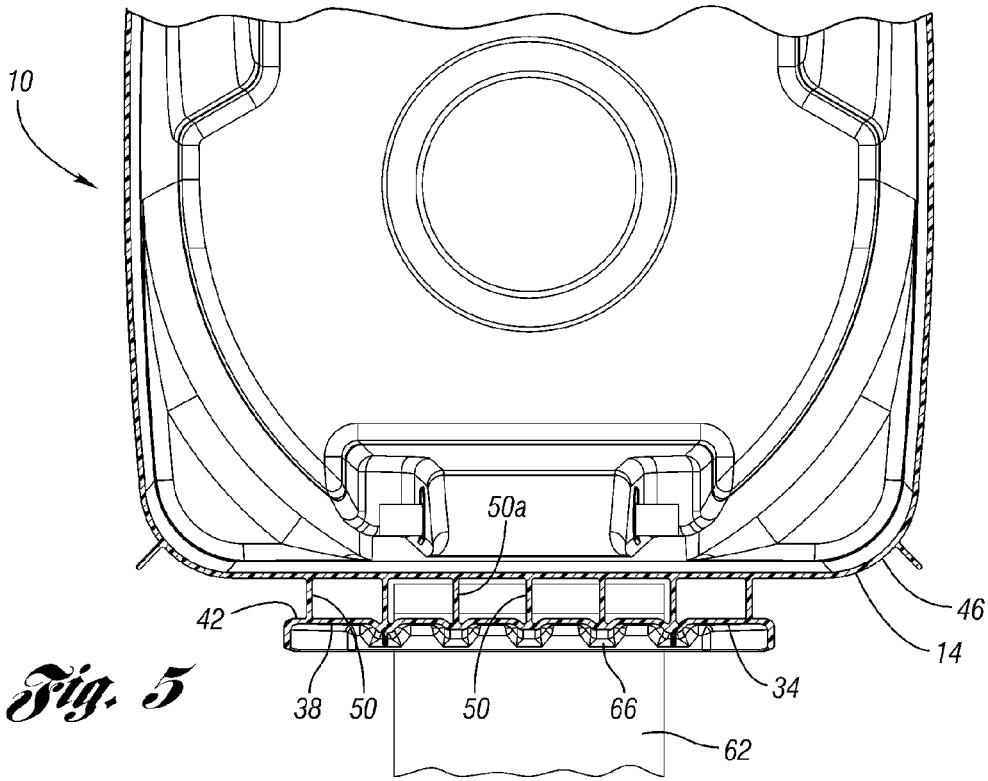
FIG. 5 is a partial section view through line 5-5 of FIG. 2.
Figure 6:
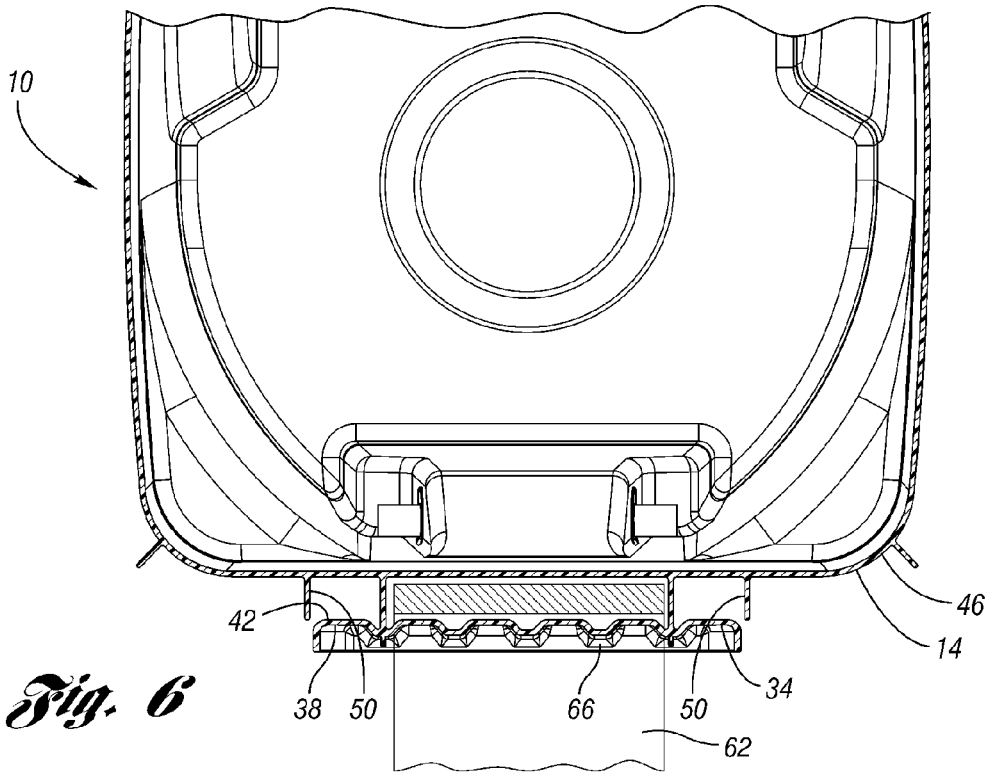
FIG. 6 is a partial section view through line 6-6 of FIG. 2.

Referring to FIG. 1, an example roll-out trash cart 10 includes a hollow, axially extending body 14 coverable with a lid member 18. A hinge member 22 connects the lid member 18 to the body 14. The body 14 establishes an opening 20 for loading and unloading items from the body 14. The cart 10 includes handle members 26 and wheels 30 for manipulating the position of the cart 10. Other example uses for the cart 10 include collecting other items, such as recyclable items, non-recyclable items, or leaves.

Referring now to FIGS. 2-6 with continuing reference to FIG. 1, the cart 10 includes a skirt 34 that extends downwardly from an area of the body 14 near the opening 20. The skirt 34 includes an outwardly facing surface 38 and an inwardly facing surface 42. A portion of the skirt 34 is spaced from an outwardly facing surface 46 of the body 14.

In this example, a group of support ribs 50 span between the outwardly facing surface 46 of the body 14 and the inwardly facing surface 42 of the skirt 34. The support ribs 50, the inwardly facing surface 42 of the skirt 34, and the outwardly facing surface 46 of the body 14 establish a lifter receiving area 58 between a portion of the skirt 34 and a portion of the body 14. The lifter receiving area 58 is configured, for example, to receive a lifter 62 from a trash truck. The lifter 62 moves into the lifter receiving area 58 to engage the cart 10. Once engaged with the cart 10, the lifter 62 begins tipping the cart 10.

The support ribs 50*a* are vertically truncated relative to others of the support ribs 50. In this example, the lifter receiving area 58 is established by the lower edge portions of the support ribs 50*a* and sides of others of the support ribs 50. The lifter 62 contacts at least some of the support ribs 50 as the lifter 62 engages the cart 10 within the lifter receiving area 58. As can be appreciated, aligning the lifter 62 as the lifter 62 engages the cart 10 facilitates engagement.

In this example, the skirt 34 includes a plurality of alignment features 66 disposed on or near the outwardly facing surface 38 of the skirt 34. The alignment features 66 are corrugations 70*a* and 70*b* of the skirt 34 in this example. The corrugations 70*a* extend axially further than the corrugations 70*b*. In this example, the corrugations 70*a* correspond to the horizontal boundary or width of the lifter receiving area 58. The corrugations 70*b* are horizontally aligned with the support ribs 50*a*.

An operator (not shown) directing the lifter 62 into the lifter receiving area 58 would understand to align the lifter 62 horizontally between the corrugations 70*a*. The varied axial lengths of the corrugations 70*a* and 70*b* thus facilitates aligning the lifter 62 as the lifter 62 moves to an engaged position with the cart 10. That is, the varied axial lengths of the corrugations 70*a* and 70*b* provides a visual hint to location of the lifter receiving area 58, which facilitates aligning the lifter 62 as the lifter 62 is received within the lifter receiving area 58.

Figure 7:
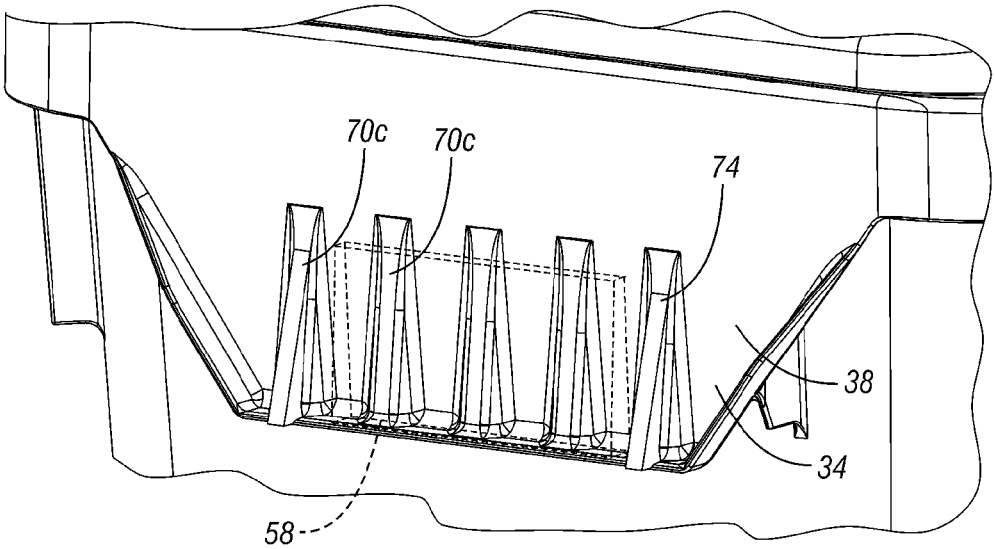
FIG. 7 is a perspective close-up view of the FIG. 1 cart having another example skirt.

Referring to the FIG. 7 example, the alignment features 66 comprise corrugations 70*c* and indicator ribs 74. The indicator ribs 74 extend away from the outwardly facing surface 38 of the skirt 34. In this example, the corrugations 70*c* extend axially similar distances and the indicator ribs 74 correspond to the horizontal boundary or width of the lifter receiving area 58. The corrugations 70*c* and indicator ribs 74 thus provide a visual hint to location of the lifter receiving area 58, which facilitates aligning the lifter 62 as the lifter 62 is received within the lifter receiving area 58.

Figure 8:
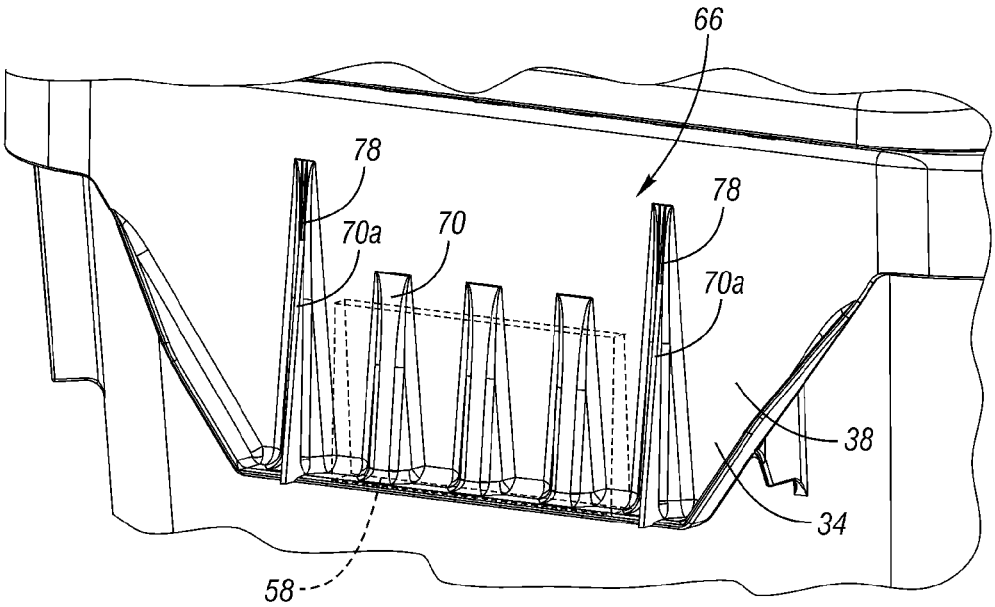
FIG. 8 is a perspective close-up view of the FIG. 1 cart having yet another example skirt.

Referring to the FIG. 8 example, the alignment features 66 comprise corrugations 70*a* and 70*b*, and indicator ribs 78. In this example, the indicator ribs 78 extend outwardly from the corrugations 70*a*. The axial lengths of the indicator ribs 78 correspond generally to the axial lengths of the corrugations 70*a*. As can be appreciated, the axial length of the indicator ribs 78 and the corrugations 70*a* is greater than the axial length of the corrugations 70*b*. The differences between axial lengths of the corrugations 70*b*, and the indicator ribs 78 and the corrugations 70*a* provide a visual hint to location of the lifter receiving area 58, which facilitates aligning the lifter 62 as the lifter 62 is received within the lifter receiving area 58.

Features of the disclosed examples include providing a visual hint to the location the lifter receiving area. The visual hint is provided near an outwardly facing surface of the lifter.

Although a preferred embodiment has been disclosed, a worker of ordinary skill in this art would recognize that certain modifications would come within the scope of this invention. For that reason, the following claims should be studied to determine the true scope and content of this invention.

We claim:

1. A cart comprising:

a body establishing an opening for loading and unloading items from the body;

a skirt extending downwardly from a portion of the body;

a plurality of support ribs spanning from the body to the skirt, the plurality of support ribs establishing a lifter receiving area together with an outwardly facing surface of the body and an inwardly facing surface of the skirt; and a plurality of corrugations in the skirt, wherein each of the plurality of support ribs is aligned with one of the plurality of corrugations having a first axial length or is aligned with one of the plurality of corrugations having a second axial length longer than the first axial length, wherein the corrugations corresponding to the support ribs that establish a width of a lifter receiving area have the second axial length.

2. The cart of claim 1 wherein the plurality of corrugations comprises at least one corrugation of the skirt that extends longitudinally a first length and at least one corrugation of the skirt that extends longitudinally a second length longer than the first length.

3. The cart of claim 1 wherein the plurality of corrugations comprises at least one indicator rib.

4. The cart of claim 1 wherein at least some of the support ribs establish a horizontal width of the lifter receiving area.

5. The cart of claim 1 wherein the plurality of support ribs comprise truncated support ribs that establish a vertical height of the lifter receiving area.

6. The cart of claim 5 wherein the plurality of corrugations comprises at least one corrugation of the skirt that extends longitudinally a first length and at least one corrugation of the skirt that extends longitudinally a second length longer than the first length.

7. The cart of claim 6 wherein the at least one corrugations extending longitudinally a first length is directly opposite one of the plurality of truncated support ribs.

8. The cart of claim 1, wherein the plurality of corrugations are separate and distinct from the plurality of support ribs.

9. The cart of claim 1, wherein the plurality of corrugations extend outwardly from the outwardly facing surface.

10. The cart of claim 1, wherein the plurality of corrugations extends to and terminates at a downwardmost edge of the skirt.

11. A cart comprising:

a body extending axially and establishing an opening for loading and unloading items from the body;

a skirt secured to the body; and a plurality of support ribs extending between the skirt and the body, wherein the plurality of ribs, the skirt, and the body each have portions that together establish a lifter receiving area, and the skirt comprises a plurality of corrugations in the skirt, wherein each of the plurality of support ribs is aligned with one of the plurality of corrugations having a first axial length or is aligned with one of the plurality of corrugations having a second axial length longer than the first axial length, wherein the corrugations corresponding to the support ribs that establish a width of a lifter receiving area have the second axial length.

12. The cart of claim 11 wherein the plurality of corrugations in the skirt are separate and distinct from the plurality of support ribs.

13. The cart of claim 12 wherein the plurality of corrugations further comprises indicator ribs extending outwardly from at least some of the plurality of corrugations.

14. The cart of claim 11 wherein the skirt extends downwardly from an area of the body near the opening.

15. The cart of claim 11 wherein the cart is a roll-out cart.

16. The cart of claim 11, wherein exclusively the plurality of support ribs establish an upper boundary of the pocket.

17. A roll out cart comprising:

a body extending axially and establishing an opening for loading and unloading items from the body;

a skirt secured to the body;

a plurality of support ribs extending between the skirt and the body some of which establish a width of a lifter receiving area; and a plurality of corrugations in the skirt, wherein each of the plurality of support ribs is aligned with one of the plurality of corrugations having a first axial length or is aligned with one of the plurality of corrugations having a second axial length longer than the first axial length, wherein the corrugations corresponding to the support ribs that establish a width of a lifter receiving area have the second axial length.

18. The cart of claim 17, wherein the plurality of corrugations extend to a downward edge of the skirt.

19. The roll out cart of claim 17 wherein the corrugations opposing the support ribs that do not establish the width of the lifter receiving area have the first axial length.

20. The roll out cart of claim 17 including outwardly extending ribs disposed on at least some of the corrugations having the second axial length.

21. The cart of claim 11, including a first number of support ribs and a second number of the plurality of corrugations, the first number different than the second number.

* * * * *